US009829251B2

(12) United States Patent
Peterle et al.

(10) Patent No.: US 9,829,251 B2
(45) Date of Patent: Nov. 28, 2017

(54) HYDRONIC/BIPHASIC RADIATOR WITH REDUCED THERMAL INERTIA AND LOW ENVIRONMENTAL IMPACT

(75) Inventors: Michele Peterle, San Pietro di Feletto (IT); Simone Visentin, Santa Lucia di Piave (IT); Diego Trentin, Mareno di Piave (IT); Federico Zoppas, Treviso (IT)

(73) Assignee: I.R.C.A. S.P.A. Industria Resistenze Corazzate e Affini, San Vendemiano (IT)

( * ) Notice: Subject to any disclaimer, the term of this patent is extended or adjusted under 35 U.S.C. 154(b) by 692 days.

(21) Appl. No.: 14/241,021

(22) PCT Filed: Aug. 24, 2012

(86) PCT No.: PCT/IB2012/054293

§ 371 (c)(1),
(2), (4) Date: Feb. 25, 2014

(87) PCT Pub. No.: WO2013/027194

PCT Pub. Date: Feb. 28, 2013

(65) Prior Publication Data

US 2014/0199055 A1 Jul. 17, 2014

(30) Foreign Application Priority Data

Aug. 25, 2011 (IT) ..... RM2011A0449

(51) Int. Cl.
*F28D 1/02* (2006.01)
*F24H 3/00* (2006.01)
(Continued)

(52) U.S. Cl.
CPC ..... *F28D 1/0226* (2013.01); *F24H 3/004* (2013.01); *F24H 3/12* (2013.01); *F28D 7/103* (2013.01);
(Continued)

(58) Field of Classification Search
CPC ..... F28D 1/0226; F28D 15/02; F24H 3/004; F24H 3/12; F28F 27/00
See application file for complete search history.

(56) References Cited

U.S. PATENT DOCUMENTS 3,438,574 A * 4/1969 Killias ..... G05D 23/125 236/100
3,538,307 A * 11/1970 Birdwell ..... F24D 13/04 126/101
(Continued)

FOREIGN PATENT DOCUMENTS

EP 2012080 1/2009
FR 2357850 2/1978
(Continued)

OTHER PUBLICATIONS

International Search Report and Written Opinion dated Nov. 15, 2012 for corresponding international application patent No. PCT/IB2012/054291.

*Primary Examiner* — Anne M Antonucci
*Assistant Examiner* — Renee M LaRose
(74) *Attorney, Agent, or Firm* — Abelman, Frayne & Schwab

(57) ABSTRACT

A radiator with reduced thermal inertia, based on the principle of phase changing, using a non-toxic, non-flammable fluid with reduced environmental impact. The radiator is provided by means of vertical pipes which engage a collector containing a pipe bundle-type exchanger with smooth or finned pipes, internally crossed by the thermo-vector fluid of the system, and which heat the intermediate vector fluid, bringing it to the biphasic state. The vector fluid evaporates, rising up the vertical pipes, flowing through the channels obtained in the extruded profiles of the vertical pipes themselves. The fluid re-descends, condensing on the walls, returning into contact with the hot pipes of the exchanger in order to re-evaporate and rise back up the vertical pipes. The film of condensed liquid provides the required heat exchange. The terminal is further equipped with mechanical parts which allow the inserting of temperature sensors for possible monitoring and control of consumption and system
(Continued)

operation and control thereof, by means of on-board electronic control devices (electric valves) and remote devices suitably operating in radio-frequency.

13 Claims, 13 Drawing Sheets

(51) Int. Cl.

| | |
|---|---|
| ***F28F 27/00*** | (2006.01) |
| ***F28D 7/10*** | (2006.01) |
| ***F24H 3/12*** | (2006.01) |
| *F28D 15/02* | (2006.01) |
| *F28D 15/06* | (2006.01) |

(52) U.S. Cl.
CPC ..... *F28D 15/02* (2013.01); *F28F 27/00* (2013.01); *F28D 15/0266* (2013.01); *F28D 15/06* (2013.01)

(56) References Cited

U.S. PATENT DOCUMENTS

| | | | | |
|---|---|---|---|---|
| 4,016,804 | A * | 4/1977 | Turecek | G05D 23/128 236/42 |
| 6,928,237 | B2 * | 8/2005 | Matsunaga | B60H 1/2221 392/480 |
| 7,764,869 | B2 * | 7/2010 | Noe | F24H 1/225 219/772 |
| 2007/0065123 | A1 * | 3/2007 | Yao | F24H 3/004 392/375 |
| 2010/0276502 | A1 | 11/2010 | Beckett | |

FOREIGN PATENT DOCUMENTS

| | | | | |
|---|---|---|---|---|
| GB | 2099980 | | 12/1982 | |
| IT | EP 1959202 | A2 * | 8/2008 | F24D 19/1015 |
| JP | 62131121 | | 6/1987 | |
| WO | 00/70286 | | 11/2000 | |
| WO | 2006/025638 | | 3/2006 | |

* cited by examiner

HYDRONIC/BIPHASIC RADIATOR WITH REDUCED THERMAL INERTIA AND LOW ENVIRONMENTAL IMPACT

CROSS REFERENCE TO RELATED APPLICATIONS

This application is a national phase of PCT application No. PCT/IB 2012/054293, filed Aug. 24, 2012, which claims priority to IT patent application No. RM 2011A000449, filed Aug. 25, 2011, all of which are incorporated herein by reference there to.

FIELD OF THE INVENTION

The present invention relates to a radiator with low thermal inertia and a very low time constant, operating with thermo-vector fluids such as hot water or glycolate mixtures, operating in biphasic regime, with application in the field of heating systems for residential and commercial buildings.

STATE OF THE ART

The current technology most widely diffused in the European field for radiators for domestic or industrial use provides a heat generator (typically a traditional or condensation-type boiler, though, more recently, heat pumps are also increasingly diffused) for single or multi-family use with hydronic distribution of the heat towards radiators, of the thermosiphon type, or towards fan coil units (especially for use in commercial buildings).

The current usage scenario for residential buildings, which reflects the current lifestyles which are typical of modern European society, taking into account the time spent at home, provides for the need for heating, as a function of this time, during several hours in the evening, during the night-time, but with extremely low heating requirements, and in the morning during a very short time and especially when waking up. Especially in the morning, it is desirable that the transition period between the night-time heating situation and the morning heating situation is rather brief, i.e. the heating speeds are higher than those currently offered, for example, by traditional thermosiphons.

Furthermore, the current technology nearly always provides for the use of thermostats or timers with on-off function, to serve the residential unit, or a single centralized control to serve the heating system thermo-vector fluid circulators, again with on-off function.

Furthermore, taking into account the aforementioned residential requirements, the objective of reducing energy consumption can only be pursued by means of an integrated approach to the design of the building-installation system and, in this sense, it is not possible to prescind from the necessity of having a plant terminal which integrates well from an architectural viewpoint in the room to be heated, shifting the attention of the architect, rather than that of the final user, towards a product which is also a furnishing component as well as a plant functional element. In view of these needs, several technical problems to solve and requirements to satisfy take shape.

The need emerges for a plant terminal with reduced inertia and a very low time constant, so as to arrange thermal requirements when actually needed and in an extremely short time, with consequent energy saving. These requirements go hand in hand with the need for immediate environmental comfort, but with the minimum impact thereon, for the entire life cycle of the product, from its production to the disposal and recycling phase.

A terminal which can possibly be integrated and interfaced with control and adjustment devices which may benefit from the management of information made available by the plant terminal structure itself. This is possible with a biphasic thermosiphon since the surface temperature of the radiator is correlated to the temperature of the intermediate vector fluid and the latter is correlatable to the inlet temperature of the plant water (or of other thermo-vector fluid) in the heat exchanger.

From the perspective of reaching comfort in the rooms, it is desired to favour radiant heat exchange, typical of thermosiphons, as much as possible, with respect to the convective one which is typical, for example, of fan coil units, which, in spite of their low inertia, often give rise to situations perceived as being of poor comfort by the user, due to the movement of air, perceived as dry, in the heating phase. In a two-phase thermosiphon, the heat exchange with the external environment is provided at nearly constant temperature and thermal flow per unit area. However, it is known that the surface distribution of the temperature can never be even on a traditional-type heater, given that the variation in water temperature through the radiator between inlet and outlet is typically around 10 degrees. This situation translates into non-optimal use, from the viewpoint of thermal radiation, of the heat exchange surface, at the expense also of the radiator size.

To sum up, the technical problem to solve is given by the need to increase the heating speed of the plant terminal and consequently the room, as a function of the aforementioned lifestyle together with energy saving, favouring the sensation of comfort of the user in the heated room, combining an excellent integration from an architectural viewpoint with the room to be heated. Preparation, from the mechanical/structural viewpoint, for the possibility of inserting temperature sensors within the radiator in order to allow monitoring and optimization of consumption and energy requirements, by means of integrating the radiator with electronic monitoring and control devices or platforms, installed on-board the radiator and/or remotely arranged and capable of processing the signal detected by the aforementioned sensors installed in the radiator. This integration will allow optimization of the operating methods, adapting them to the user real needs. The temperature of the intermediate vector fluid measured by the sensors in addition to the measurement of the flow rate of the plant (by means of sensors/pre-existing systems) allows management of information related to instantaneous consumption and previous consumption.

All of this is accompanied by the minimum environmental impact during the entire life cycle of the product.

SUMMARY OF THE INVENTION

The object of the present invention is to provide a plant terminal, in particular a radiator, adapted to solve the technical matters and requirements referred to above.

The object of the present invention is a radiator, in particular for heating rooms, comprising, according to claim 1, a radiating body made of metal comprising: a tubular-shaped collector defining a longitudinal axis and situated in the bottom part of the radiator, and adapted to contain an intermediate vector fluid functioning in the biphasic state, a heat exchanger placed within the collector, at least one pipe which is orthogonal to the longitudinal axis of the collector, comprising therein one or more channels connected to the collector and communicating with the same, characterized in that such a heat exchanger consists of one or more pipes which are parallel to the longitudinal axis of the collector and that a thermo-vector fluid from an external heating plant can flow within said pipes.

Advantageously, the radiating body is made of aluminium and the pipes which are orthogonal to the longitudinal axis of the collector are connected to the collector itself by brazing and/or interlocking systems with suitable gaskets. These pipes, which are vertical in use, are in number and height such as to satisfy the thermal power to be supplied as a function of the maximum dimensions required by the market or allowed by the various regulations and from the viewpoint of reducing the radiator weight. The choice to obtain the vertical pipes by extrusion of aluminium alloys further allows to construct radiators of varying height based also on the specific requirements of the customer without additional investment costs.

The aluminum alloy used allows the precision mechanical processes which are necessary in order to provide the joints between collector and vertical pipes. The use of aluminium alloy occurs in the most limited quantities possibile, in order to reduce the thermal inertia, the environmental impact and the cost of the device. Aluminium alloy also lends itself to extremely accurate extrusion processes, thus responding to both technological/construction requirements and architectural design requirements.

The joints can be made by brazing, gluing or by engagement/expanding with or without gaskets.

The collector is characterized by a rounded geometry with a diameter such as to allow the housing of the pipe bundle-type heat exchanger. The rounded shape further determines an acceleration of the air which increases the speed thanks to the buoyant forces due to the different density. The acceleration of the air around the collector contributes to increasing the chimney effect on the rear part of the radiator. The greater speed of the air on the rear part close to the collector may favour the positioning of a possible electronic adjustment unit which would not be visible to the user, since it is on the rear part of the radiator. The result is a further architectural integration, the adjustment technical feature is thus not visible.

The heating intermediate vector fluid in the biphasic state has low environmental impact (low direct greenhouse effect and non-existent potential for stratospheric ozone destruction, i.e. low GWP and zero ODP), and is used in limited quantity, in the initial liquid state, in comparison with the total internal volume of the radiator. Said intermediate vector fluid, initially within the collector, evaporates on contact with the heat exchanger crossed by the thermo-vector fluid and condensing on the walls of the pipe or the vertical pipes, i.e. on the walls of the internal channels of said vertical pipes, releases the latent evaporation heat making the radiator temperature basically even.

The intermediate thermo-vector fluid advantageously belongs to the hydrofluoroether family. The transient phase of the heating of said fluid is conveniently adjusted so that said fluid remains below the critical temperature at which the chemical degradation thereof begins.

The heat exchange between fluid and radiating body is provided by means of the film of intermediate fluid condensate while it descends the vertical pipes in order to return on the exchanger pipes to re-begin the evaporation and condensation process in thermodynamic equilibrium between liquid and vapor phase.

The radiating body of the thermosiphon can be dimensioned and optimized based on the the various possible applications, depending on whether the hydronic system is served by a traditional boiler, a condensation-type boiler or a heat pump, with a substantial difference in the feed temperatures of the hot water to the terminal. From the viewpoint of the transmittance of the aforementioned exchanger, the boiling process providing extremely high coefficients, the dominant thermal resistance is the hot water side one. Therefore, in models with smaller dimensions recourse is made to pipes with convenient enhanced geometries or micro-geometries adapted to the increase of the water side heat exchange coefficient, e.g. by means of the use of pipes with finnings or micro-finnings.

In these similar mechanical/thermodynamic configurations, the plant terminal puts together a heat distribution with an extremely even surface temperature on the entire heat exchange surface (all to the advantage of comfort) with similar, if not lower, times for the temperature to reach steady state to those of a fan coil unit.

In order to facilitate the nucleate boiling process, allowing the radiator to be used also in the case of the characteristic inlet temperatures of a heat pump or condensation-type boiler, which are much lower than the inlet temperatures (60-75° C.) of a traditional boiler, the radiator can be equipped with a special valve which allows a level of vacuum to be obtained within the collector, where the intermediate vector fluid is contained, such as to always allow the boiling of the fluid, even for much lower inlet water temperatures.

The valve in question consists of an external body sealingly fixed to the radiator (preferably on the collector) with a standard commercial piston and return spring mechanism screwed therein. By means of quick coupling, the valve allows the necessary vacuum to be easily provided within the radiator and the subsequent step of filling the collector with the intermediate vector fluid.

The invention relates in particular to a wall radiator, although other positions of the radiator are also possible as a function of living and style requirements.

BRIEF DESCRIPTION OF THE FIGURES

Further features and advantages of the invention will become clearer in view of the detailed description of a preferred but not exclusive embodiment of a hydronic biphasic radiator, which uses the hot water from an external heating plant as thermo-vector fluid, shown by way of non-limiting example with the aid of the accompanying drawings in which.

The reference numbers in the figures indicate the same elements or components.

DETAILED DESCRIPTION OF A PREFERRED EMBODIMENT OF THE INVENTION

Figure 1:
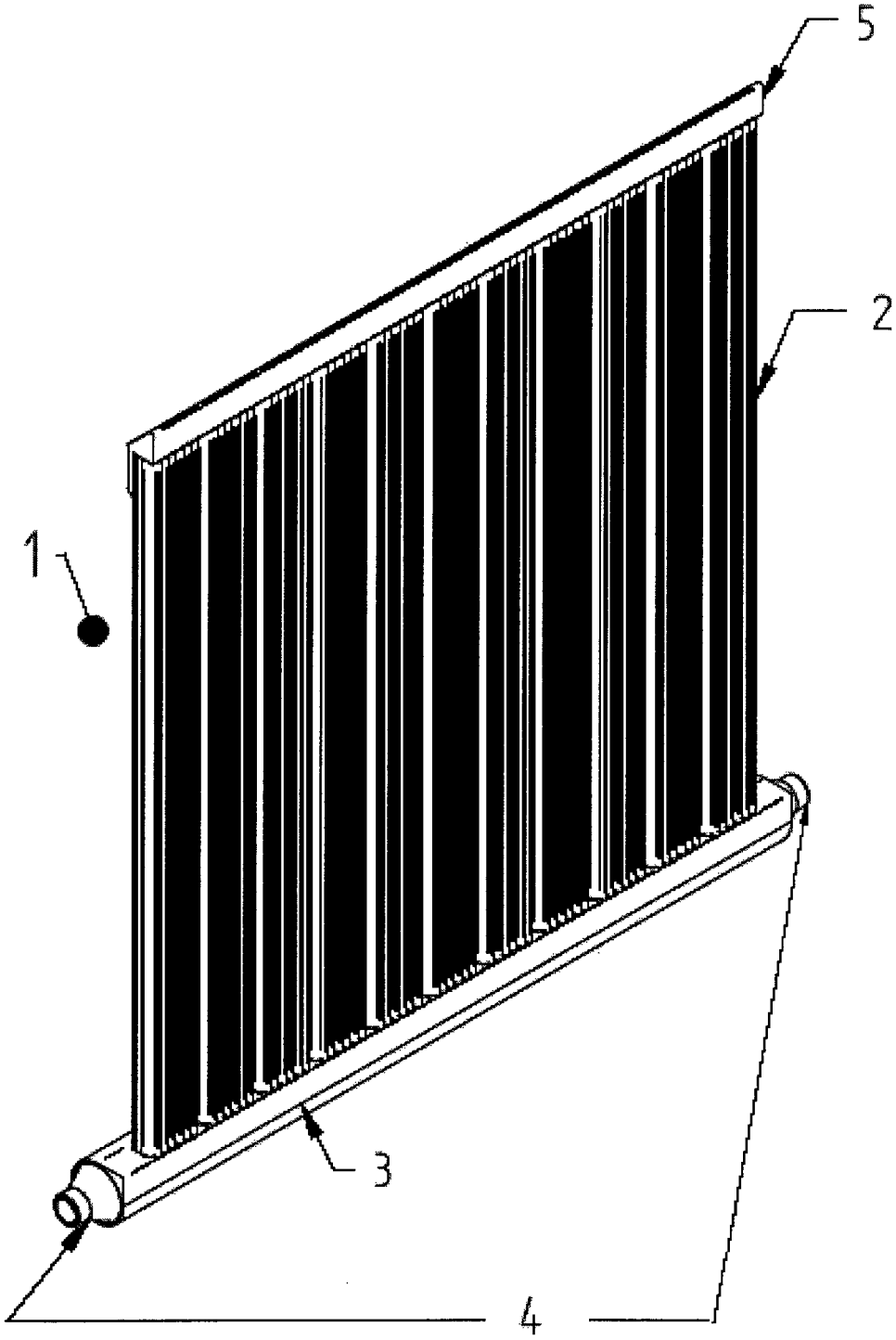
FIG. 1 shows a front view of the thermosiphon according to the present invention.
Figure 2:
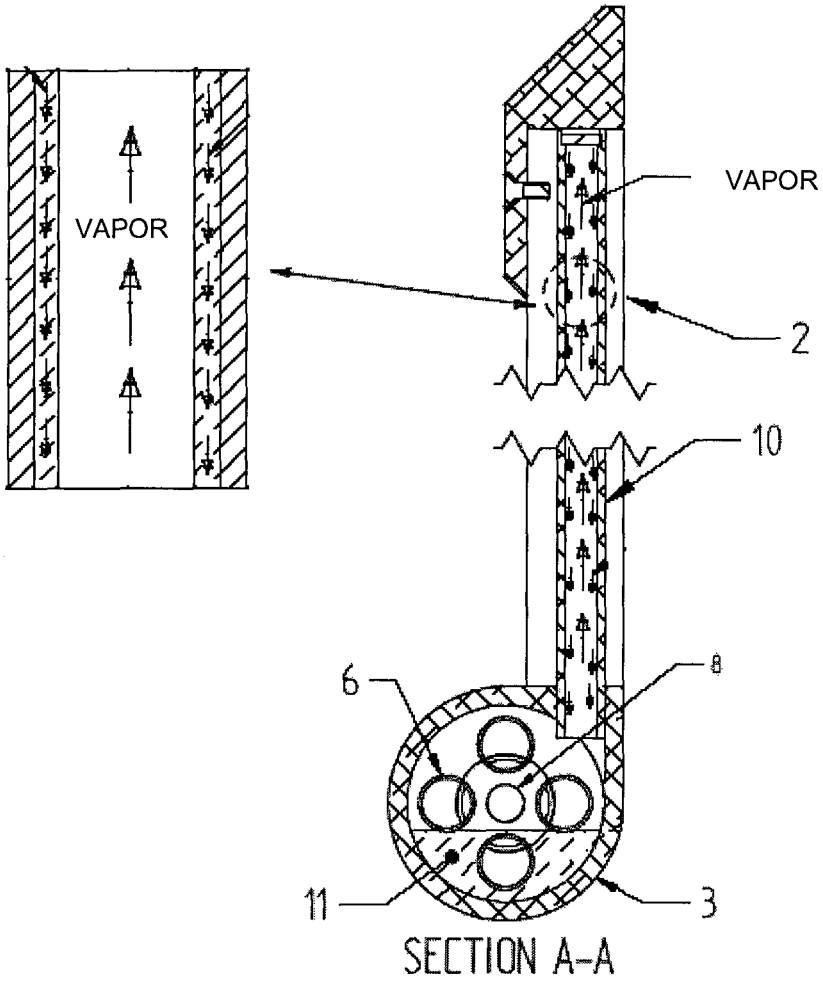
FIG. 2 shows a cross-section, which also shows the principle of operation of the biphasic thermosiphon.

A hydronic biphasic thermosiphon 1 according to the invention is shown in FIG. 1, where numeral 2 indicates the vertical pipes containing the channels along the walls of which the film of moisture forms during operation, and numeral 3 indicates the collector containing the intermediate vector fluid which, during operation, in contact with heat exchanger 6 which is found within the collector, evaporating, rises up the aforementioned channels before condensing along the walls of the same (FIG. 2).

Figure 3:
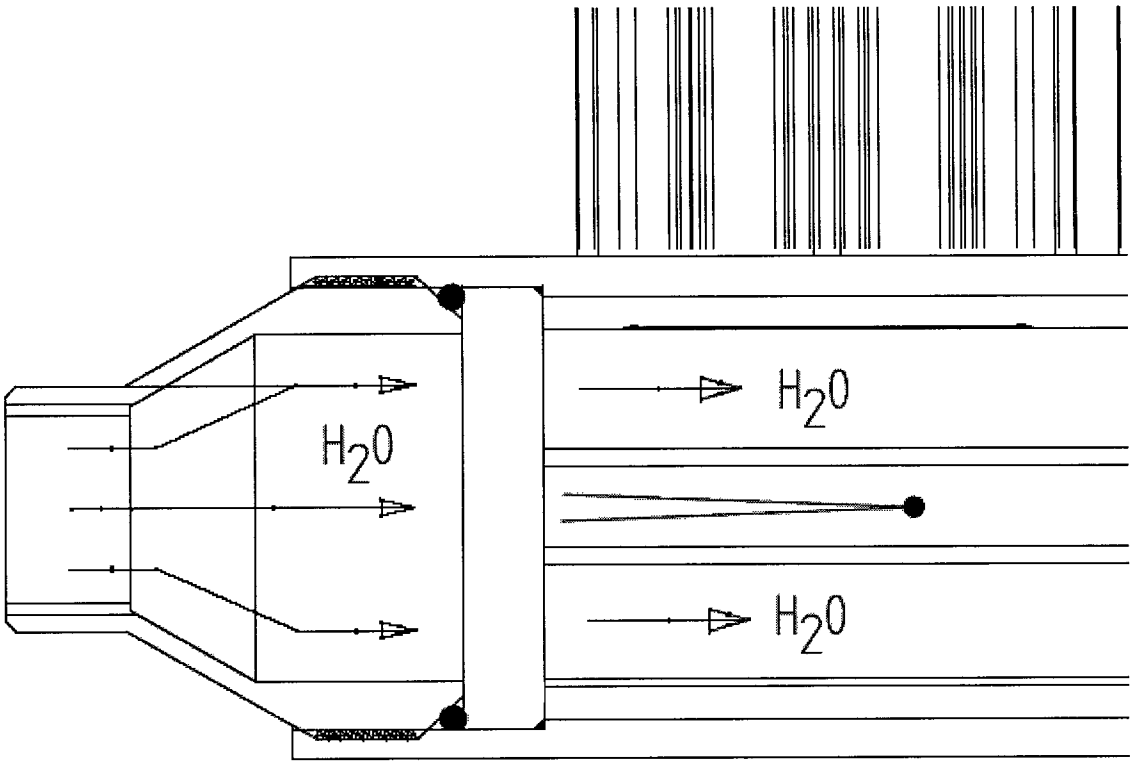
FIG. 3 shows a longitudinal section which shows the hot water (thermo-vector fluid) inlet and a bulb in a central position, with respect to the heat exchanger pipes, with a temperature sensor.

The pipe bundle-type heat exchanger, as shown in FIGS. 2 and 3 by a group of four pipes 6, is fixed to collector 3 and terminates with two sealing flanges 16, one at the inlet and the other at the outlet of the thermo-vector fluid, each of which rests on the corresponding abutment of collector 3 and is sealingly welded or brazed 14 onto the latter (FIG. 3). Each flange 16 has one or more holes (FIG. 4) for housing and sealingly fixing the pipes 6 within which the water or another thermo-vector fluid at temperature from the plant flows. The heat exchange pipes 6 can be made of aluminium, copper or steel alloy, smooth or finned or micro-finned (FIG. 5). The finning 17 allows to reduce the number of pipes or reduce the overall dimensions of the radiator inasmuch as they increase the number of triggers and nucleation of the bubbles during the biphasic heat exchange with the intermediate vector fluid. The increasing of the number of bubbles guarantees the field of existence of the heat exchange in nucleate boiling which has the highest heat exchange coefficient with the intermediate vector fluid.

The fixing of the smooth pipes generally takes place by brazing or expanding. The finned pipes, on the other hand, are fixed at one end by expanding or brazing, and at the other by means of a double expanding element with the aid of an additional fixing ferrule which allows the passing of the finning in the installation phase.

In order to prevent excessive load losses at the radiator inlet and outlet, two conical reducers 4 are used which are suitably dimensioned and engaged on collector 3. The two conical reductions 4 which protrude from collector 3 are shown by way of example, the concept is that there are two devices at the collector inlet and outlet, in particular they can be conical connections, which allow to limit load losses by guiding the water flow. In fact, the water passes through a standard connection which is usually of ½ gas size and must then enter the four pipes of the exchanger.

The conical reducer has the task of guiding the fluid threads so as to limit the load losses and therefore reduce the electrical pumping power, which leads to energy saving, as by limiting the load losses, the counter-pressure is limited and the pump must overcome a smaller pressure in order to pump the fluid.

The vertical pipes 2 are characterized by profiles, e.g. finnings, suitable fluid dynamic geometries, such as to favour a better compromise between heat exchange towards the environment and terminal weight. In particular, a finning 19 on the rear part facing the wall (FIGS. 6, 7) contributes to increasing the heat exchange by convection with the air contained between the radiator and the wall, also increasing the rising speed thereof and the chimney effect. The pitch of the fins must allow as much as possible the return of fresh air from the adjacent areas so as to accelerate as much as possible the fluid which moves due to the density gradients, increasing the heat exchange coefficient by natural convection.

Figure 10:
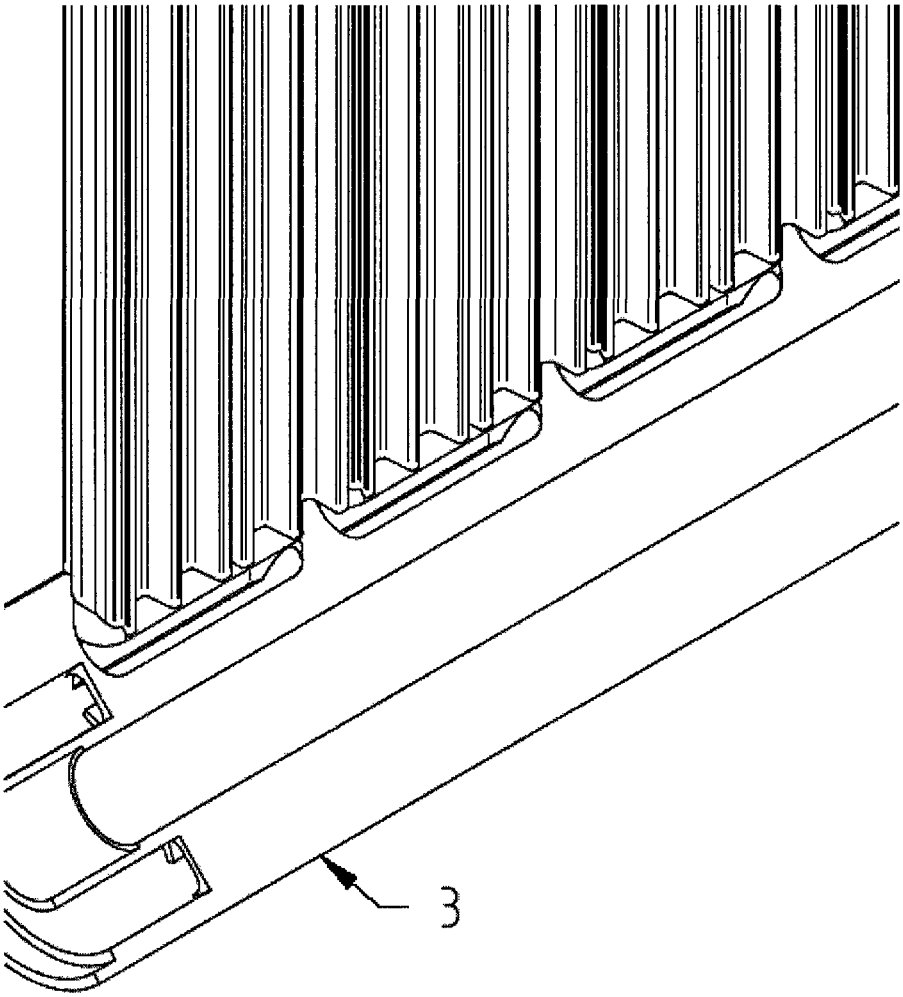
FIG. 10 shows the engagement of the vertical pipes in the collector.
Figure 11:
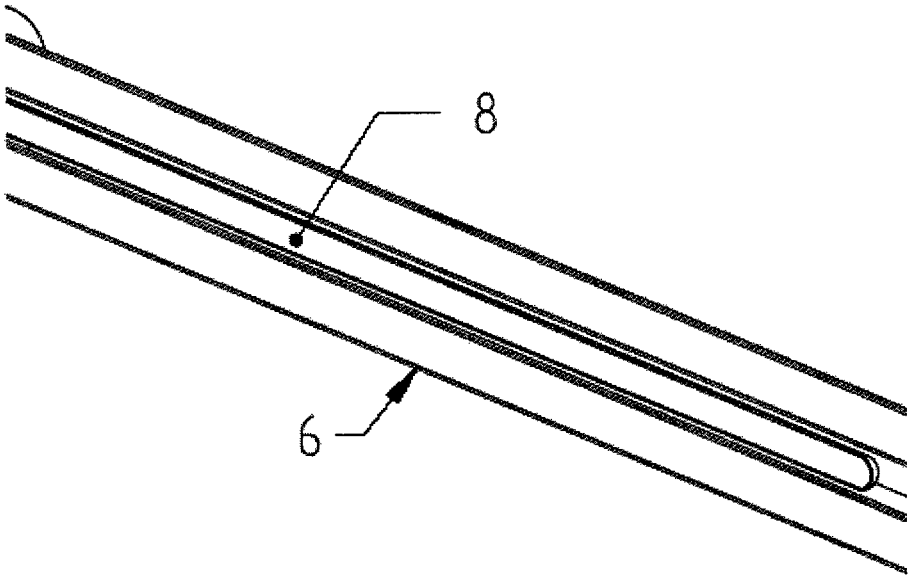
FIG. 11 shows the position of the sensor-holding bulb in the case of a heat exchanger with four pipes.
Figure 12:
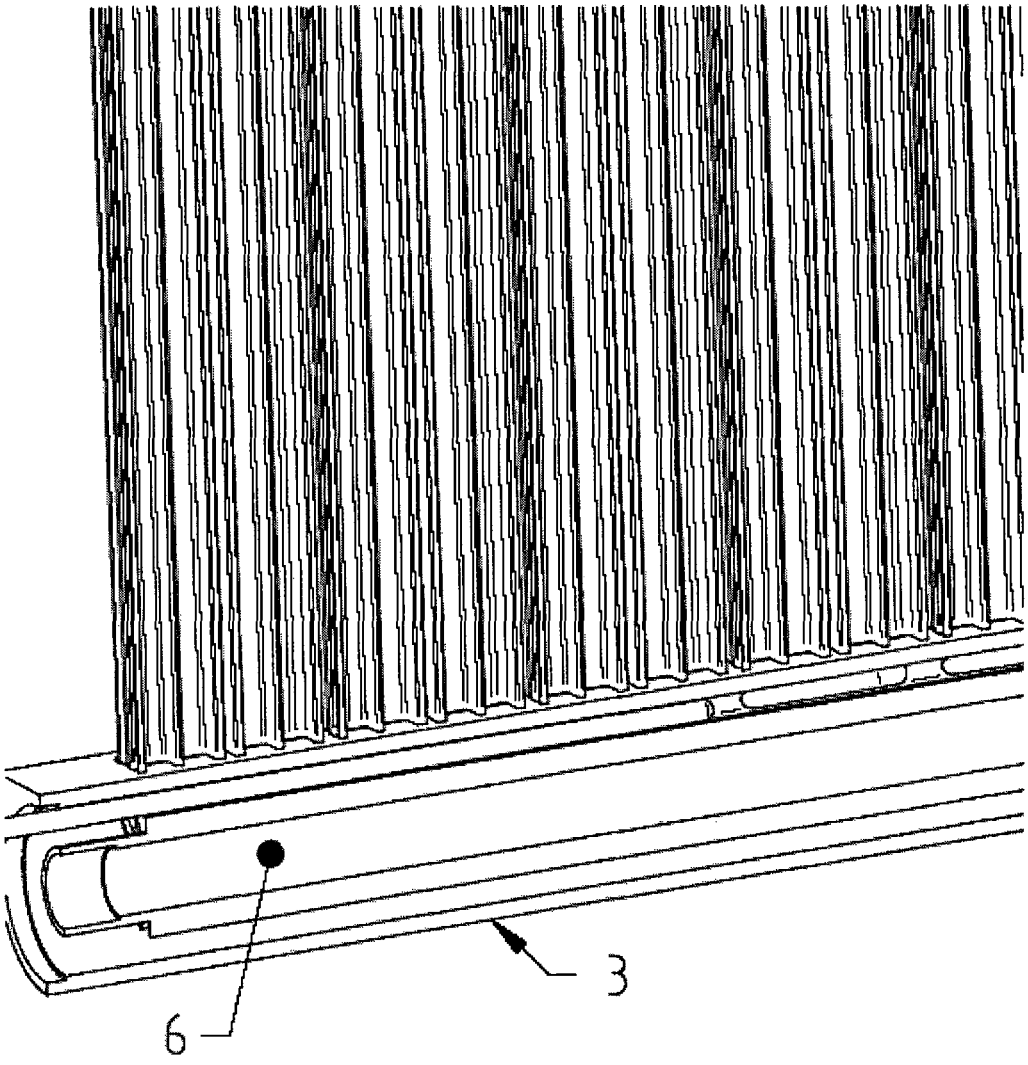
FIG. 12 shows the position of the sensor-holding bulb in the case that the heat exchanger consists of only one pipe.

By developing the surface on the rear side 19, it is possible to provide a smaller number of pipes, reducing the external dimensions of the radiator and limiting the weight and therefore the inertia of the radiator. At the front, vertical pipe 2 has stubby fins 20, in order to increase the efficiency thereof, of the smallest height possible compatibly with the engagement dimensions of vertical pipe 2 with collector 3 (FIG. 10).

The number of vertical pipes is optimized based on the power to be exchanged as a function of the water inlet temperature.

Figure 6:
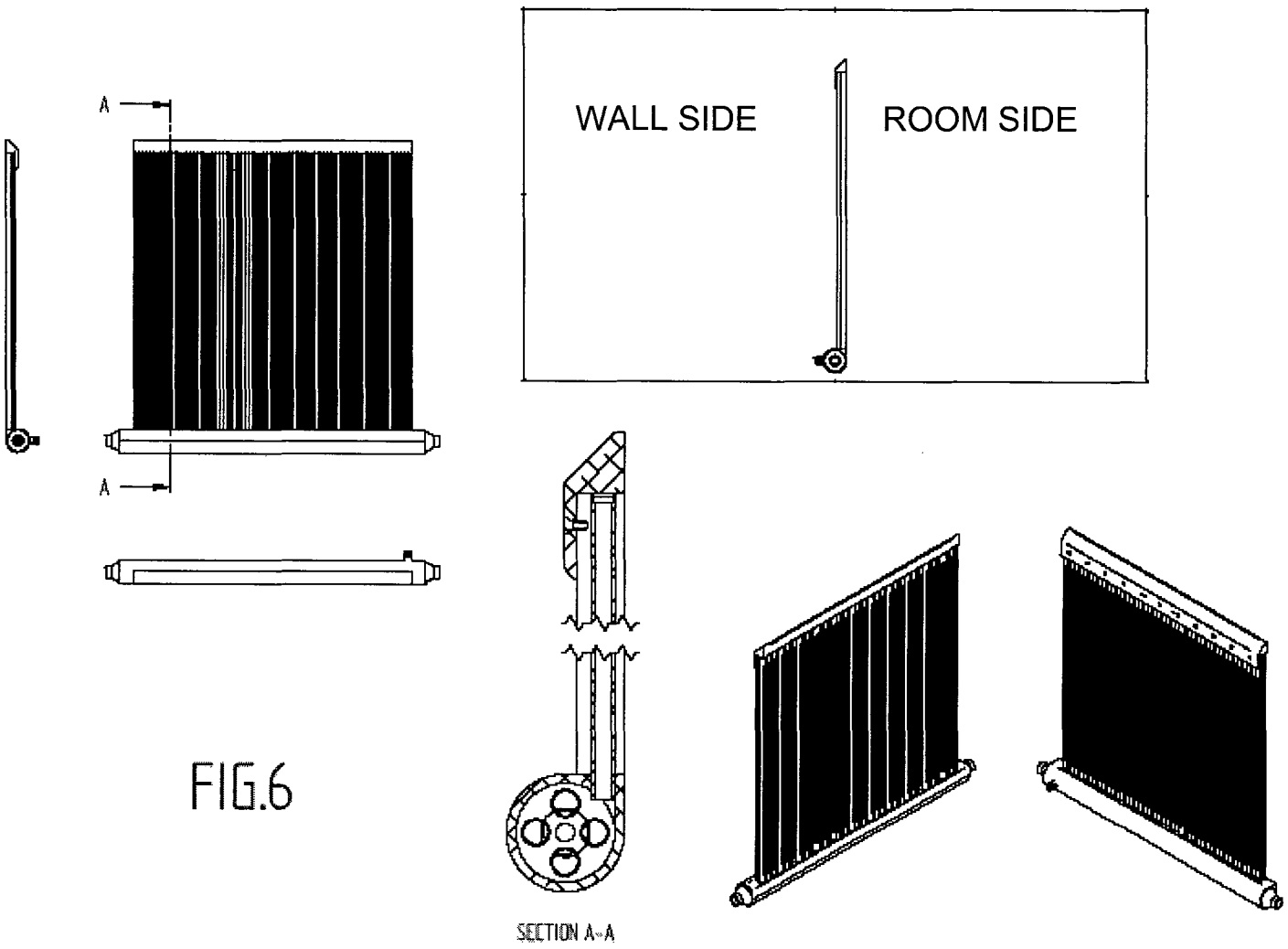
FIG. 6 shows various perspective views of the radiator and how the thermosiphon is assembled on the wall of the room to be heated.
Figure 7:
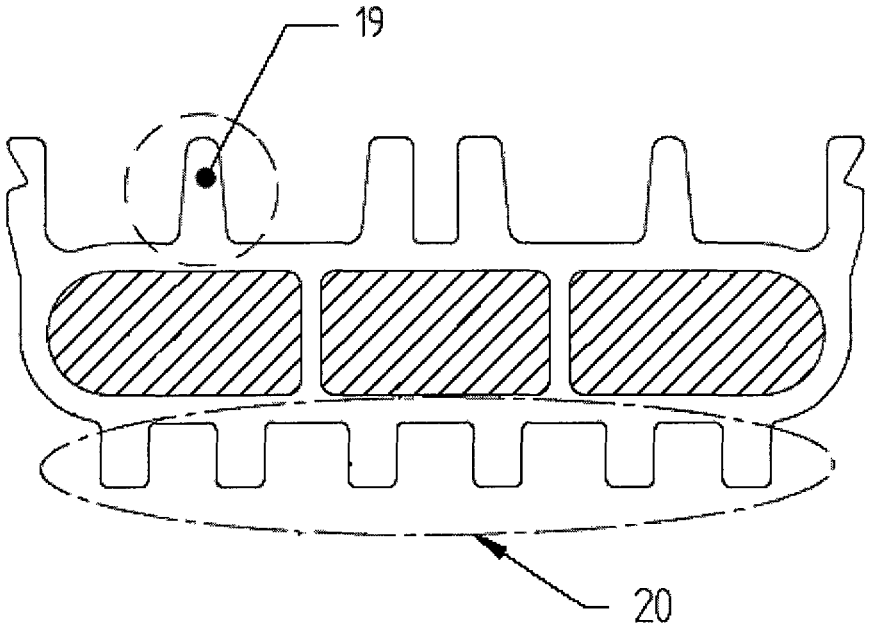
FIG. 7 shows a detail of a vertical pipe.

The small thickness, as can be noted from FIG. 6, which is less or at least equal to that of traditional furnishing thermosiphons, guarantees architectural integration. Vertical pipe 2 has therein channels 10 for passing the vapour and the film of condensate. The channels are dimensioned with the valid ratios for the biphasic heat exchange and have a greatly reduced section thanks to the extremely low surface tension of the fluid.

Figure 8:
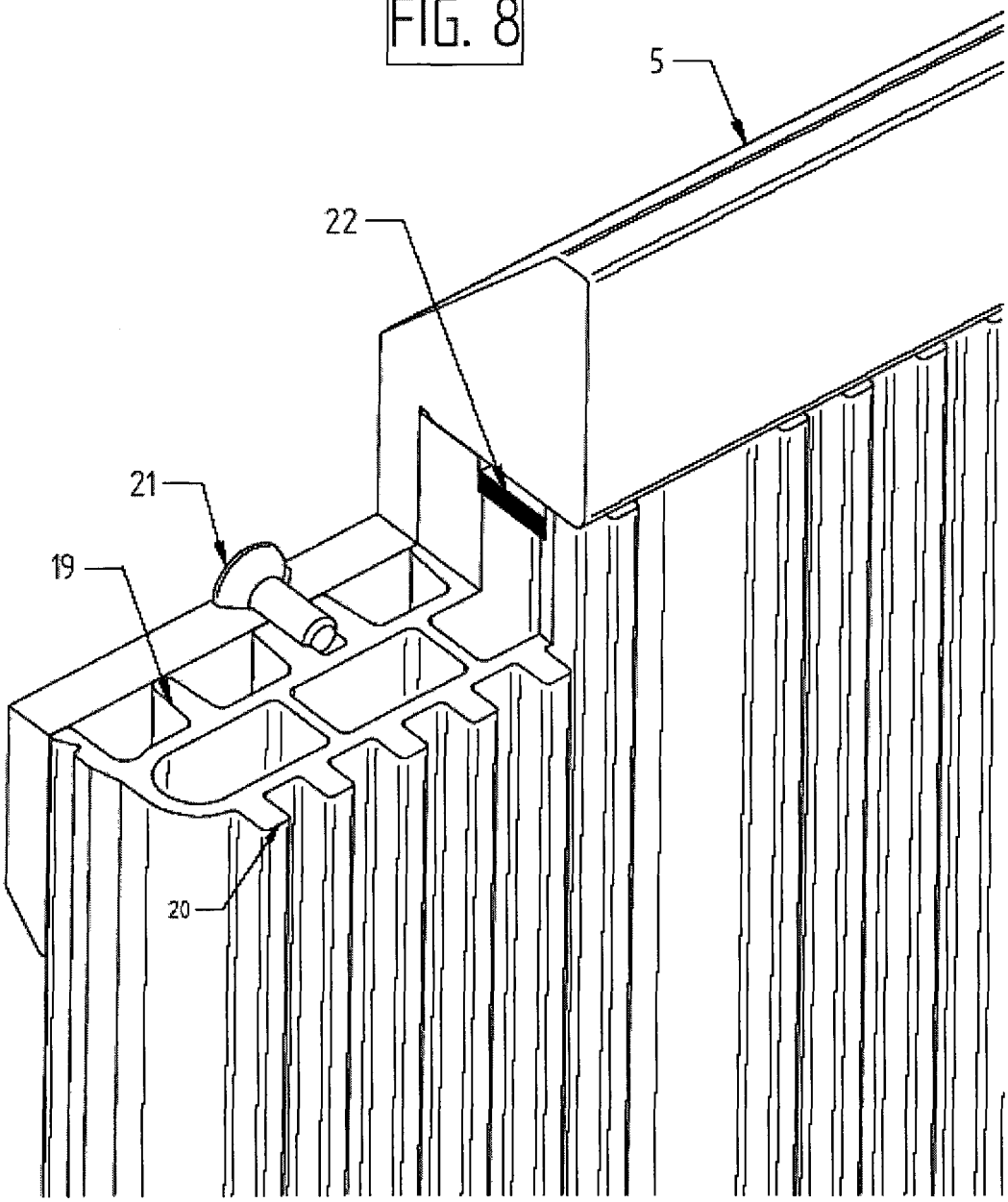
FIG. 8 shows a detail of the assembly of the crosspiece which closes the thermosiphon in the upper part.
Figure 9:
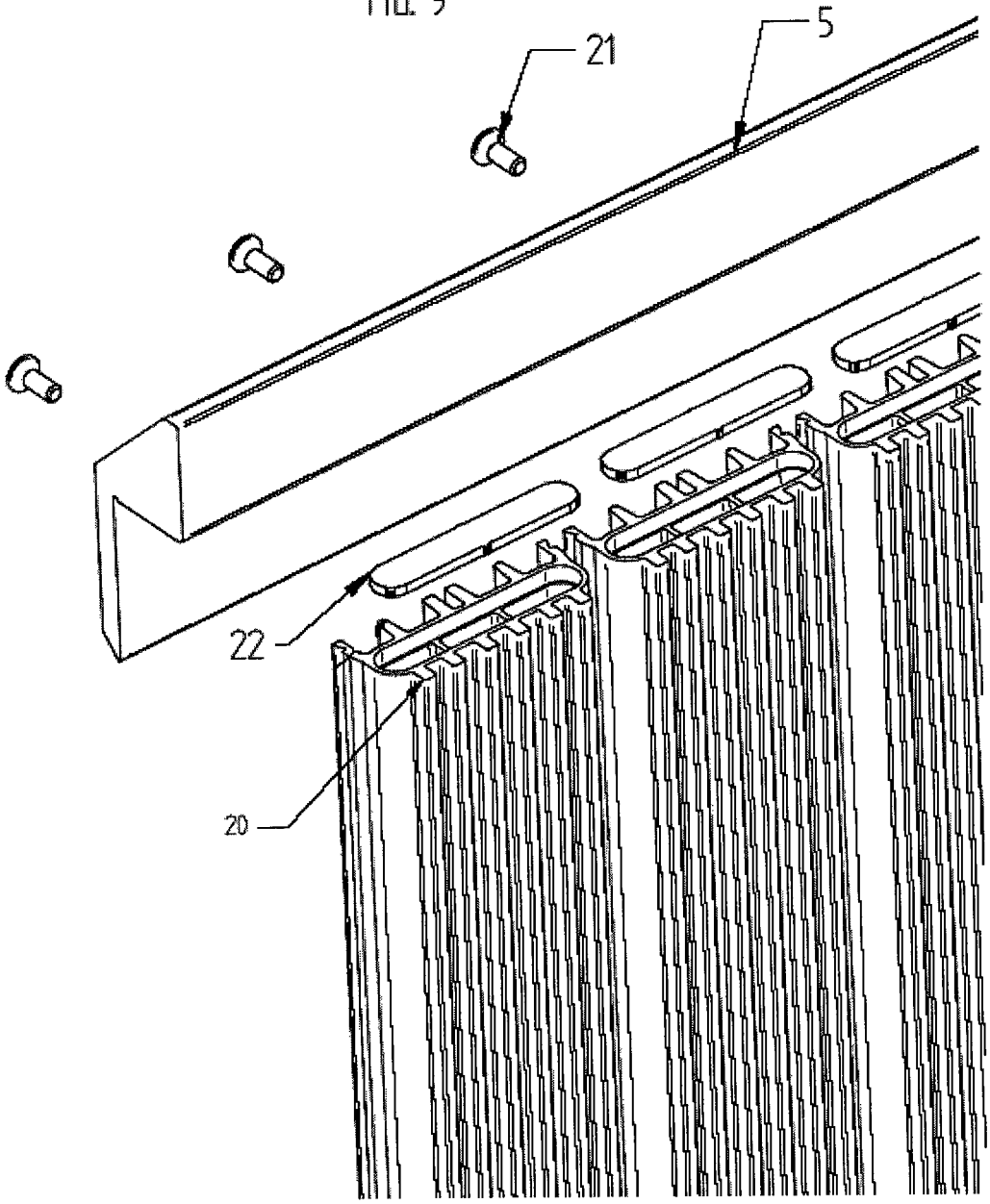
FIG. 9 shows, as in FIG. 8, the assembly of the crosspiece and the closing of the vertical pipes.

The minimum passage section as a function of the low surface tension and viscosity of the fluid are such as to allow a pipe to be provided with a smaller thickness than traditional furnishing radiators. Furthermore, the technology of the biphasic radiator, not necessitating a collector 3 also on the upper part, allows to reduce the weight of the entire radiator which has only one collector on the lower part and an aesthetic and structural crosspiece 5 on the upper part. The crosspiece (FIGS. 8, 9) can be screwed with self-threading screws 21 on specific hollow slots obtained directly on the extruded profile of the vertical pipe. The vertical pipes are closed on the upper part with aluminium plugs 22 obtained by fine blanking, so as to guarantee the narrow tolerances necessary for providing the brazed joint, and equipped with specific interlocking teeth for housing on the corresponding hollow one on the vertical pipe obtained by mechanical process.

Figure 4:
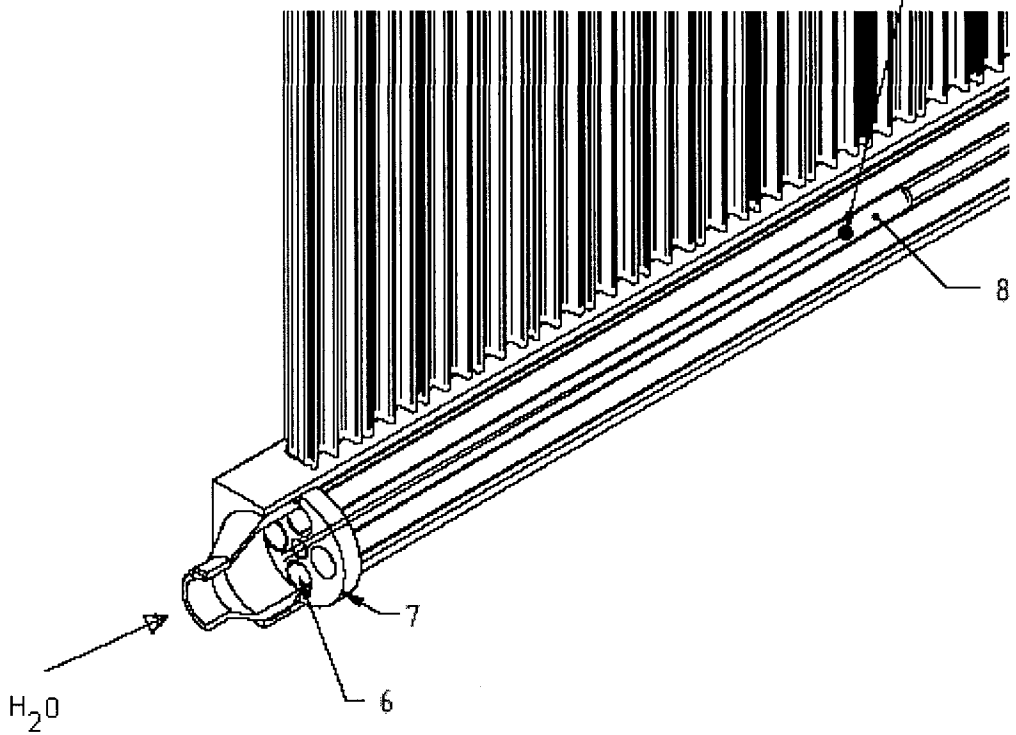
FIG. 4 is another representation of the collector with the heat exchanger, and a sealing flange.
Figure 5:
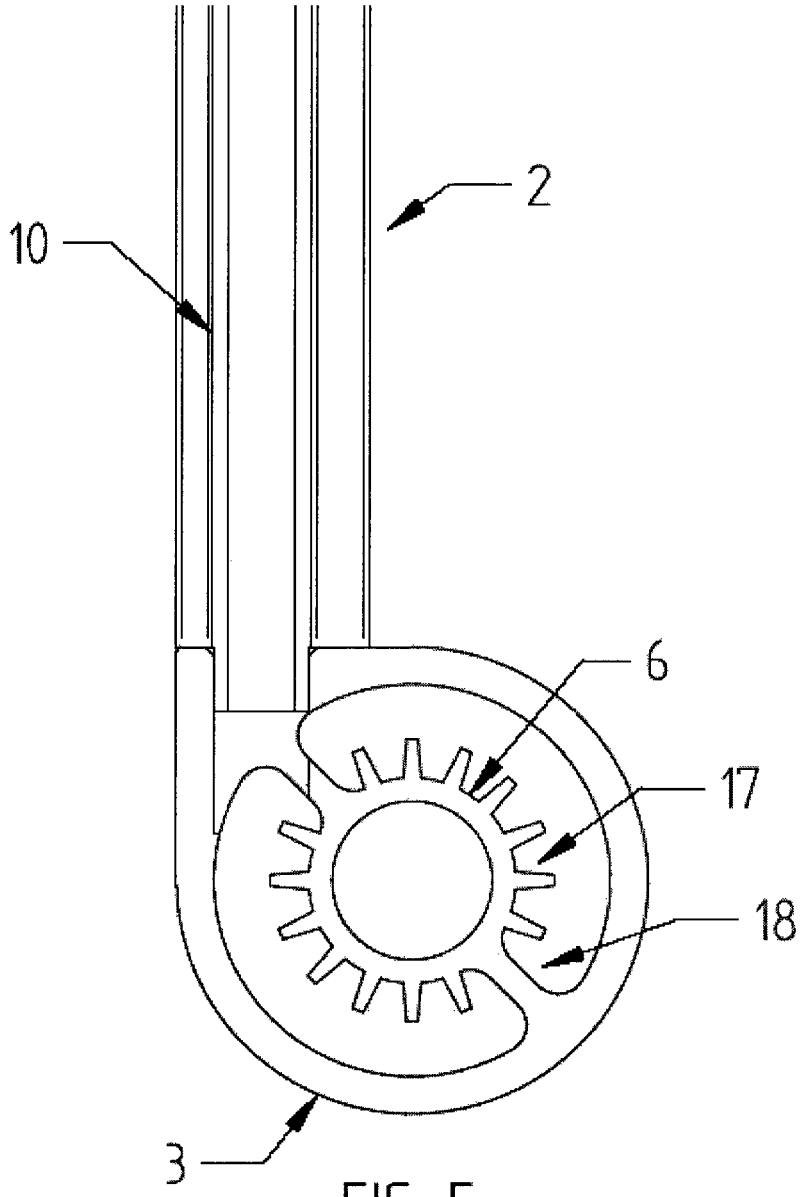
FIG. 5 shows a cross-section with, at the centre of the collector, a heat exchanger provided as a single pipe.

In FIGS. 3 and 4, there is shown a heat exchanger formed by four pipes 6 which are parallel to the longitudinal axis of collector 3 which contains them.

In FIG. 5, there is depicted a variation with a heat exchanger 6 consisting of a single central pipe, with respect to collector 3, which can be equipped with micro-finning 17. The collector is provided starting from an extruded profile with a tubular profile at the centre which is supported and connected to the collector by means of one or two fins 18 in such a configuration as to allow in any case a sufficient efflux of intermediate vector fluid which wets and exchanges heat with the surface of central pipe 6. In this variation, the heat exchanger is the central pipe 6 and is already integrated in the starting extruded profile. The central pipe 6 may be longitudinally finned, the fins 17 are directly obtained by extrusion. This configuration facilitates the production of the radiator, using the brazing of the two head flanges 7 as fixing technology. The mechanical processes are also relatively simple: they involve suitably working the front end of the collector, so as to remove the fins which support the central pipe and the fins of the central pipe itself in order to create a shoulder which allows the housing of two flanges which will be brazed onto the collector. The two flanges guarantee the sealing of the system and contribute towards supporting the central pipe.

In FIG. 4 a bulb, in this case centrally arranged, holds a temperature sensor 8 which may be in contact with the heat exchanger pipes 6 or in direct contact with the intermediate vector fluid. The possibility to insert temperature sensors within the collector, in contact with the exchanger pipes or in direct contact with the fluid, gives the possibility to integrate the system terminal with advanced devices for controlling and monitoring energy consumption and comfort for complete home automation integration and reduction of energy consumption.

For this purpose, the collector may be equipped with one or more bulbs, not shown in the drawings, i.e. cylindrical containers adapted to house the temperature sensors for controlling the heat exchange process between intermediate vector fluid and the thermo-vector fluid from the heating system, so as to maintain the system in better heat exchange conditions (nucleate boiling) without exceeding the critical thermal flow conditions of the fluid.

Furthermore, the hydronic radiator can be integrated, if necessary, with control and adjustment devices directly connected thereto, such as systems comprising a flow adjustment valve or electric valve, specifically connected to the collector inlet, giving the possibility of modulating the inlet flow of the thermo-vector fluid from the heating plant, therefore modulating the thermal power conferred to the radiator and supplied therefrom to the environment.

Eventually, the electric valve may also be remotely controlled in radio-frequency, by means of an electronic control console, providing an integrated system capable of improving the global efficiency of the heating process of residential and commercial environments.

In order to implement the aforementioned control system, it is possible to equip the radiator with a cylindrical housing, part of the exchanger, in direct contact with the intermediate vector fluid in the biphasic state and within which one or more temperature sensors may be inserted in order to detect the temperature of the intermediate vector fluid. The signal from these sensors can be processed by the possible control electronics as a temperature feedback signal and as a parameter which is correlatable with the operating conditions of the radiator and the plant (plant monitoring). The intermediate vector fluid temperature, compared with the room temperature read by an environment probe or a probe placed on the control electronics onboard the radiator, can provide useful information for adjusting the thermo-vector fluid flow entering the radiator, allowing to modulate the flow and the power supplied by the radiator as a function of the real requirements and therefore the required energy consumptions.

The same probe eventually installed can at the same time supply a feedback to the possible control electronics installed on the radiator, in order to implement the desired control logics of the biphasic heat exchange process between the heat exchange and the biphasic fluid, in order to optimise the heat exchange coefficient with the biphasic fluid remaining in the heat exchange range for nucleate boiling.

By keeping the instantaneous values of the intermediate vector fluid temperature under control, the condition of heat exchange between intermediate vector fluid in the biphasic state and heat exchanger is maintained, in nucleate boiling regime, maximising its heat exchange coefficient and preventing the fluid from working in critical flow conditions.

Figure 13:
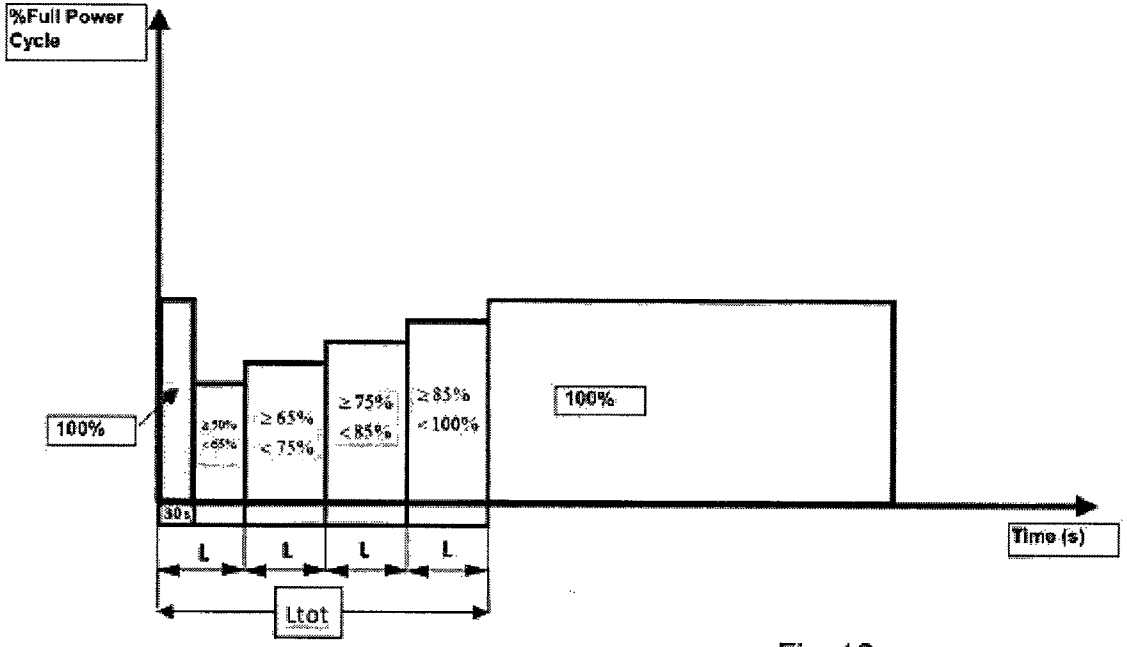
FIG. 13 shows the transient phase of the intermediate vector fluid heating.

It has been discovered that using intermediate vector fluids particularly from the hydrofluoroether family, the critical flow is a function of the room temperature (coinciding with the temperature of the fluid before it is heated by the thermal source, i.e. the thermo-vector fluid). The critical phase of operation occurs when the radiator is at room temperature (therefore "cold") and is fed by the thermo-vector fluid passing in the heat exchanger. In particular, in the most severe case in which, starting from the room temperature, the radiator is fed at the maximum power, the external temperature of the heat exchanger takes on rather high peak temperature values in the first instants of operation and for a good period of the transient, before reaching the regime. The hydrofluoroethers are characterised by a maximum usage temperature, critical temperature, above which the chemical degradation of the fluid takes place. If it is found that the radiator may have this criticality, a control electronics adjustment algorithm known as "Soft Start" may be adopted which is capable of maintaining the intermediate vector fluid temperature at the heat exchanger surface below the critical value of chemical degradation. The electronics modulate/choke the thermal power supplied by the thermo-vector fluid to the intermediate vector fluid, so as to maintain/control the intermediate vector fluid temperature below the critical temperature. In FIG. 13, an illustrative diagram is shown of the rising choked ramp during the heating transient. In the first 30 seconds, the radiator supplies full power in order to preheat the fluid and cause it to largely evaporate. It then supplies between 50 and 65% for a total time "L" (which in the first choking comprises 100% for thirty seconds plus 50-65% for the remaining L-30 sec). The other incremental power stretches then follow which last the same time L. The duration of each interval depends on the room temperature at which the radiator is found when the feeding/heating step begins (starting from cold). The lower the room temperature, the greater the duration L must be. It is possible to calibrate the duration of each interval based on various intervals of room temperature. The system with incremental powers and durations L has the function of gradually causing the intermediate vector fluid to evaporate, keeping the boiling regime in the nucleate boiling phase by allowing the vapour to reach the top of the vertical pipes and giving the liquid film time to re-descend, maintaining the intermediate vector fluid temperature at the heat exchanger surface below the temperature of chemical degradation. Based on the complexity of the regulator and the calculation resources, it is possible to vary both the duration L and the corresponding choked power, by creating more steps than those represented (in the direction of a continuous adjustment of the soft start), all of this as a function of the temperature detected by the sensor placed within the radiator at the heat exchanger surface, so as to maintain the fluid temperature below the critical value. When the temperature at the thermo-vector fluid/intermediate vector fluid interface rises, if it exceeds the limit, the electronic control will immediately provide for decreasing the supplied instantaneous power and increasing the corresponding duration L. The control of the power introduced into the intermediate thermo-vector fluid takes place by varying the thermo-vector fluid flow by actuating a special electric valve with an opening and closing control. The soft start has a limited total duration (Ltot) and is interrupted when the radiator enters the adjusting mode of the room temperature (i.e. within the band of room temperature adjustment). The soft start has the advantage, by keeping the boiling in the nucleated phase and limiting the temperature peak at the fluid/thermal source interface, of allowing the use of thermal sources with high thermal flows per unit area. The use of an intermediate vector fluid in the biphasic state with low surface tension and viscosity allows to reduce the efflux channels, the internal volume of the radiator and consequently the weight of the entire structure, to a minimum. In particular, this results in a greatly reduced thickness of the pipe or vertical pipes with a perfect integration on an architectural level with more modern style interiors.

The use of biphasic heat exchange technology with finned pipes in the exchanger, combined with optimisation of the finning on the rear and front part of the radiator, leads to optimising the surface heat exchange wherein the entire surface basically exchanges heat at the same temperature. The optimisation of the heat exchange in conjunction with the weight reduction of the radiating body and the limited content of the intermediate vector fluid, as a first consequence leads to a consistent reduction of the time constant, limiting the transient times, satisfying the requirement of energy saving and meeting the requirements of the lifestyle of contemporary society.

From the perspective of room comfort, the biphasic hydronic radiator, due to the heat exchange in boiling regime, favours the radiating heat exchange, by maximising the radiating efficiency of the surface, thanks to the uniformity of the thermal map of the surface. Finally, due to the vacuum level, the possibility of using various fluids with different boiling points at atmospheric pressure is provided, but especially the possibility to always assure the evaporation and therefore the biphasic heat exchange with even surface distribution of temperature on the radiator also for plant water inlet temperatures which are characteristic of a heat pump or condensation-type boiler.

The invention claimed is:

1. A radiator of the thermosiphon type comprising a radiating body made of metal which comprises:

a tubular-shaped collector defining a longitudinal axis and situated in the bottom part of the radiator, and adapted to contain an intermediate vector fluid functioning in the biphasic state, a heat exchanger placed within the collector, consisting of one or more pipes which are parallel to the longitudinal axis of the collector and within which pipes a thermo-vector fluid from an external heating plant can flow, at least one pipe which is orthogonal to the longitudinal axis of the collector, containing therein one or more channels connected to the collector and communicating with the same, an adjustment system integrated within the radiator itself, in order to adjust the temperature of the intermediate vector fluid as a function of the thermal requirements of the room, a temperature sensor inside the collector for measuring the temperature of the intermediate vector fluid in contact with the heat exchanger.

2. The radiator according to claim 1, wherein the radiating body is made of aluminum.

3. The radiator according to claim 1, wherein the intermediate vector fluid can evaporate, under conditions of nucleate boiling, on contact with a surface of the heat exchanger.

4. The radiator according to claim 3, wherein the surface of the pipes which constitute the heat exchanger, has micro-fins in order to favour the nucleation phenomena.

5. The radiator according to claim 1, wherein the thermo-vector fluid is water.

6. The radiator according to claim 1, where the temperature sensor is inserted in a pipe parallel to a pipe of the heat exchanger.

7. The radiator according to claim 6, comprising a valve adapted to modify the thermo-vector fluid flow at the heat exchanger inlet.

8. The radiator according to claim 7, comprising a feedback-type control system in order to maintain the conditions of evaporation in the state of nucleate boiling.

9. Use of the radiator according to claim 1, for replacing a traditional radiator and using the same heating and thermo-vector fluid circulation system in order to supply the heat exchanger.

10. The method for adjusting the thermal conditions of a room heated by a radiator according to claim 1, wherein the adjustment of the temperature takes place by adjusting the thermo-vector fluid flow at the heat exchanger inlet by means of a valve.

11. The method according to claim 10, wherein the valve which controls the thermo-vector fluid flow can be remotely controlled by radio-frequency.

12. The method for controlling the operation of a radiator according to claim 11, wherein the nucleate boiling regime is maintained by adjusting the temperature of the intermediate vector fluid on contact with a wall of the heat exchanger by means of a variation of the thermo-vector fluid flow at the heat exchanger inlet.

13. The method for controlling the operation of a radiator according to claim 12, wherein, during the transition period between the moment in which the intermediate vector fluid is at room temperature and the moment in which it reaches the desired temperature, the heating of the intermediate vector fluid is electronically controlled by using a suitable operating sequence which maintains the temperature of said fluid below the critical temperature at which the chemical degradation of the fluid begins.

* * * * *